United States Patent [19]

Nikoloff et al.

[11] Patent Number: 4,766,015

[45] Date of Patent: Aug. 23, 1988

[54] PHOSPHOLIPID LUBRICANT FOR COATING MOVING WEBS

[75] Inventors: Koyu Nikoloff; Raymond J. Peltier, both of N. Kingston, R.I.

[73] Assignee: Bercen, Inc., Cranston, R.I.

[21] Appl. No.: 40,632

[22] Filed: Apr. 21, 1987

[51] Int. Cl.[4] ..... B05D 3/00

[52] U.S. Cl. ..... 427/326; 427/361; 260/403; 252/49.5; 252/49.8

[58] Field of Search ..... 427/361, 326; 260/403

[56] References Cited

U.S. PATENT DOCUMENTS

| | | | |
|---|---|---|---|
| 2,291,616 | 8/1942 | Fletcher | 427/326 |
| 2,296,933 | 9/1942 | Jordan | 260/403 |
| 3,068,111 | 12/1962 | Seymour | 260/403 |
| 4,173,679 | 11/1979 | Kleber et al. | 260/403 |
| 4,243,461 | 1/1981 | Jaisle et al. | 156/208 |
| 4,262,058 | 4/1981 | Saunders | 427/411 |
| 4,426,330 | 1/1984 | Sears | 260/403 |

FOREIGN PATENT DOCUMENTS

| | | |
|---|---|---|
| 3101914 | 2/1982 | Fed. Rep. of Germany . |
| 27146 | 1/1980 | Hungary . |
| 39898 | 6/1979 | Japan . |
| 139430 | 1/1980 | Japan . |
| 45775 | 1/1980 | Japan . |
| 146741 | 3/1980 | Japan . |
| 155792 | 4/1981 | Japan . |
| 189892 | 1/1982 | Japan . |
| 123089 | 5/1982 | Japan . |

OTHER PUBLICATIONS

Staley Protein Division Technical Data Sheet No. 94 573120.

American Lecithin Company, Inc.'s technical sheet "Information on Alcolec Lecithin".

Central Soya Chemurgy Division's technical booklet "The Lecithin Book".

*Primary Examiner*—Thurman K. Page

*Assistant Examiner*—L. R. Home

[57] ABSTRACT

Phospholipids such as lecithins provide improved rheological properties for coating a rapidly moving web, such as a paper web. The phospholipids are preferably applied to the paper web as part of a coating mixture, and they can be included in the coating mixture by first including the phospholipid in a lubricant additive mixture that includes an emulsifier, a fatty acid vehicle, and plasticizer. The lubricant is well-suited for short-dwell coating methods.

13 Claims, 2 Drawing Sheets

PHOSPHOLIPID LUBRICANT FOR COATING MOVING WEBS

BACKGROUND OF THE INVENTION

This invention relates to lubricant additives for coating moving paper and paper board webs.

Paper and paper board web material is frequently coated to improve properties such as appearance and printability. The coating process involves applying a coating mixture to the paper as it moves at high speed through a coating apparatus. These coatings are typically composed of: (1) pigments, such as Kaolin clay, titanium dioxide, calcium carbonate or silicates; (2) adhesive binders, such as starches, styrene butadiene latex, or polyvinyl acetates; and (3) additives, which improve or modify specific properties and characteristics of the coating mixture.

A number of chemical phenomena and physical forces (particularly shear forces) can have a detrimental effect, e.g., destroying the integrity and uniformity of both the coating mixture and the coating as it is applied to the paper sheet. When this occurs, costly problems develop both in the application of the coating and in the finish and quality of the coated paper. These problems are widely known to manufacturers of coated papers.

These problems are greatly magnified as the speed of the web moving through the coating apparatus is increased, causing increased shear forces on the coating mixture being applied. Increased speed causes problems in viscosity control, calcification, streaking, whiskering, and generally poor "runnability" (performance) of the coating. These problems ultimately result in a poor quality coated sheet. Uniformity of the coating mix at these high shear levels is critical.

Typically, lubricant additives, such as calcium stearate dispersions or polyethylene emulsions, have been used as an additive to the coating mixture to improve the performance and uniformity of the coating and the overall integrity of the coating mixture. The main function of a lubricant additive in a coating mixture is to increase the lubricity of the coating. However, many other effects of lubricants are known to the art of coating paper. For example, such characteristics as rheological properties, plasticity, smoothness, coating gloss, anti-dusting and improved printing qualities, can be affected by the use of coating lubricants.

SUMMARY OF THE INVENTION

We have discovered that phospholipids compositions such as "lecithins" described below significantly improve the rheological properties of aqueous coatings for rapidly moving webs, such as paper webs, generally enabling high web speeds and high levels of solid loading in the coating mixture.

One aspect of the invention features a method of applying an aqueous-based coating to a rapidly moving paper or paper board web in which an additive comprising the phospholipid is included in the coating mixture to be applied to the web. By aqueous-based, we mean the vehicle for the coating mixture is water or water and water-miscible fluids.

Preferably, the phospholipid is a "lecithin" which comprises phosphatidylcholine, phosphatidylethanolamine, phosphatidylinositol, phosphatidic acid, or mixtures thereof. Also preferably, a fatty acid selected from linoleic, linolenic, oleic, palmitic, stearic, and coconut fatty acids, is included in the coating mixture. The coating mixture to be applied to the web further comprises a pigment, particularly an inorganic pigment such as clay. The coating mixture is applied to paper or paperboard webs traveling at least 500 feet/min (and most preferably much faster, e.g. over 1500 feet/min). Also preferably, a "short-dwell" method is used; i.e., a method in which the coating mixture is applied to the web under pressure while a device such as a doctor blade controls coating thickness. The preferred coating mixture has a solids content by weight of between 50 and 75%, and the solids portion comprises (by weight): 10–90% binder, 10–90% pigment, and 0.2–5% phospholipid. To make the coating mixture a lubricant additive mixture containing 25–75% phospholipid, 10–40% fatty acid, and 5–25% emulsifier is provided and then mixed with a pigment-containing formulation. The phosopholipid lubricant additive mixture can include an emulsifier (e.g., an anionic, cationic, non-ionic, or amphoteric surfactant), particularly a fatty acid ethoxylate and a plasticizer (e.g., a polyol such as a glycol, particularly dipropylene glycol).

The resulting coating mixture enables a high solids content and can be used in high-speed paper coating equipment, e.g. "short dwell" equipment. The preferred coating mixture comprises clay pigment (e.g., Kaolin clay), but other coatings also can be used, such as coatings comprising calcium carbonate, titanium dioxide, silica, zinc oxide, aluminium powder, synthetic polymers, talc, and diatomaceous earth.

A second aspect of the invention features a lubricant additive mixture adapted for combination with an aqueous-based paper or paperboard coating mixture, comprising a phospholipid, a fatty acid, (particularly one of the above described acids) and a surfactant. Preferred lubricant additive mixtures are those described above.

A third aspect of the invention features an aqueous paper or paperboard coating mixture comprising clay (e.g., Kaolin) and a phospholipid as a lubricant, the mixture preferably being a slurry adapted for application to a rapidly moving web. The coating mixture is preferrably the mixture described above with regard to the first aspect of the invention.

The invention enables desirable rheological properties at high solid loading in the slurry, thus reducing the energy consumed to dry the liquid from the coated product. In addition, the invention maintains the smoothness and integrity of high-solid coatings, reducing unevenness or calcification. Specifically, the invention greatly improves the rheological properties and runnability of the wet coating at high speeds and in shear stress systems. In addition, this invention improves the characteristics of the dried coated paper.

This invention allows the use of coating mixtures in excess of 50% solids by weight. The lubricant can be supplied at 100% active ingredient level. This feature allows the coating formulator to prepare coating mixtures at desirable high solids levels and reduces the amount of water present in the mixture which must be subsequently dried after application.

This invention improves the runnability of the coating mixture in high speed coaters and good results have been obtained on many types of coating equipment. The coating additive contributes to the production of a high quality, uniformly coated web which possesses excellent finish and printing characteristics. Finally, the lubricant is adaptable to high speed technology and generally compatible with coating mixture components.

Other features and advantages of the invention will be apparent from the following description of the preferred embodiments.

BRIEF DESCRIPTION OF THE DRAWINGS

We first briefly describe the drawings of the preferred embodiment of the invention.

Methods of Coating

Figure 1:
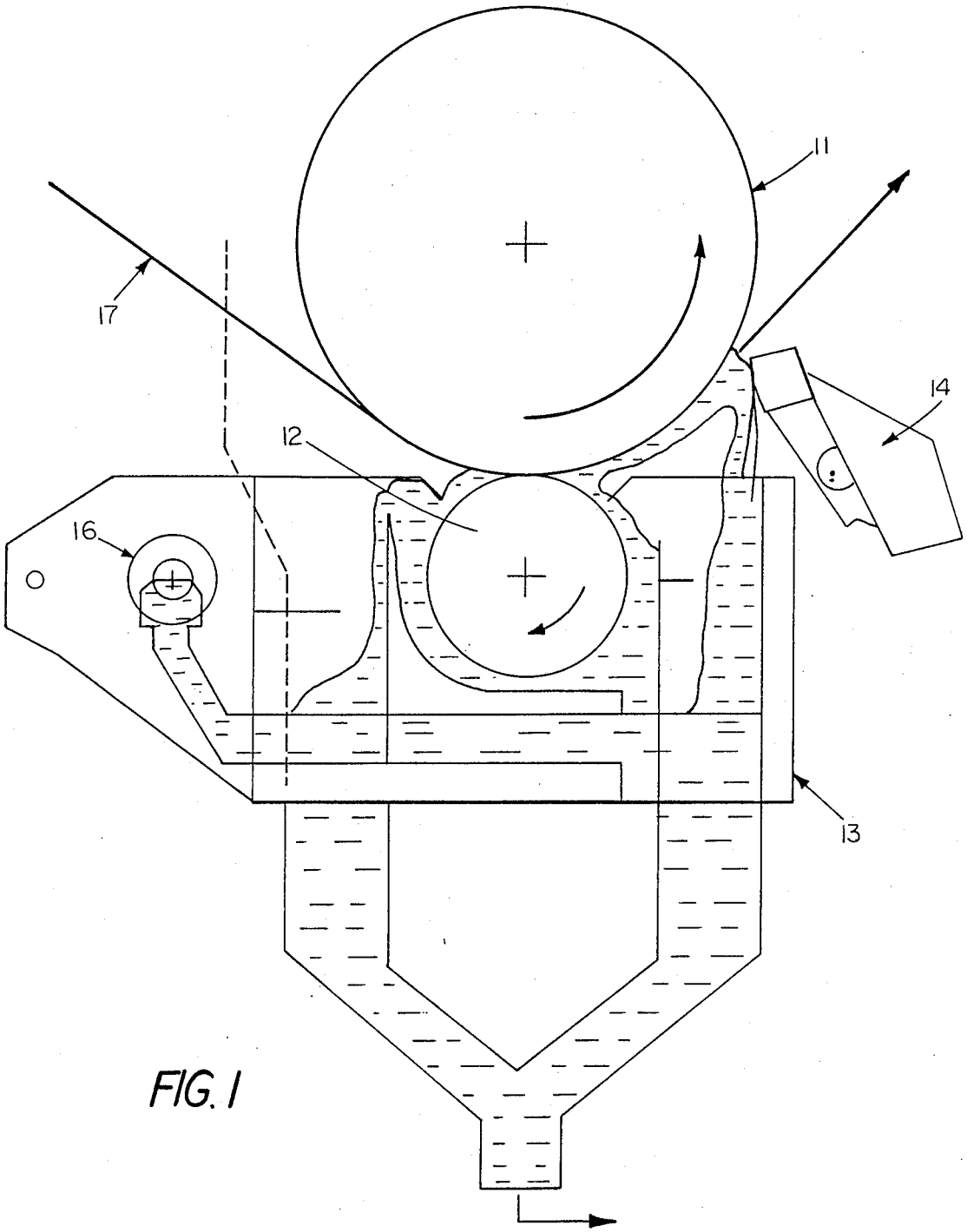
FIG. 1 is a highly diagrammatic representation of apparatus for coating a paper web according to one embodiment of the invention.

FIG. 1 depicts one type of apparatus for coating a paper web, known as a flooded nip coater. Such coaters are utilized for the application of a coating mixture to a moving paper web that travels at high speed through the coater. The basic components of coater 10 are as follows. The paper web 17 moves over a backing roll 11 in the direction indicated on the diagram.

The application roll 12 runs in a pan or reservoir 13 of coating mixture. This mixture has been prepared and the phospholipid lubricant has been added to it during its preparation. The coating is stored in a supply tank and pumped to a header pipe 16. The applicator roll 12 applies a layer of coating to the paper web as it travels through the nip formed by the applicator and backing rolls. Excess coating is removed by a knife blade 14. This knife is positioned in such a way that a uniform layer of coating of appropriate thickness is coated on the web. The design and operation of this type of coater is well known to the paper coating industry.

Figure 2:
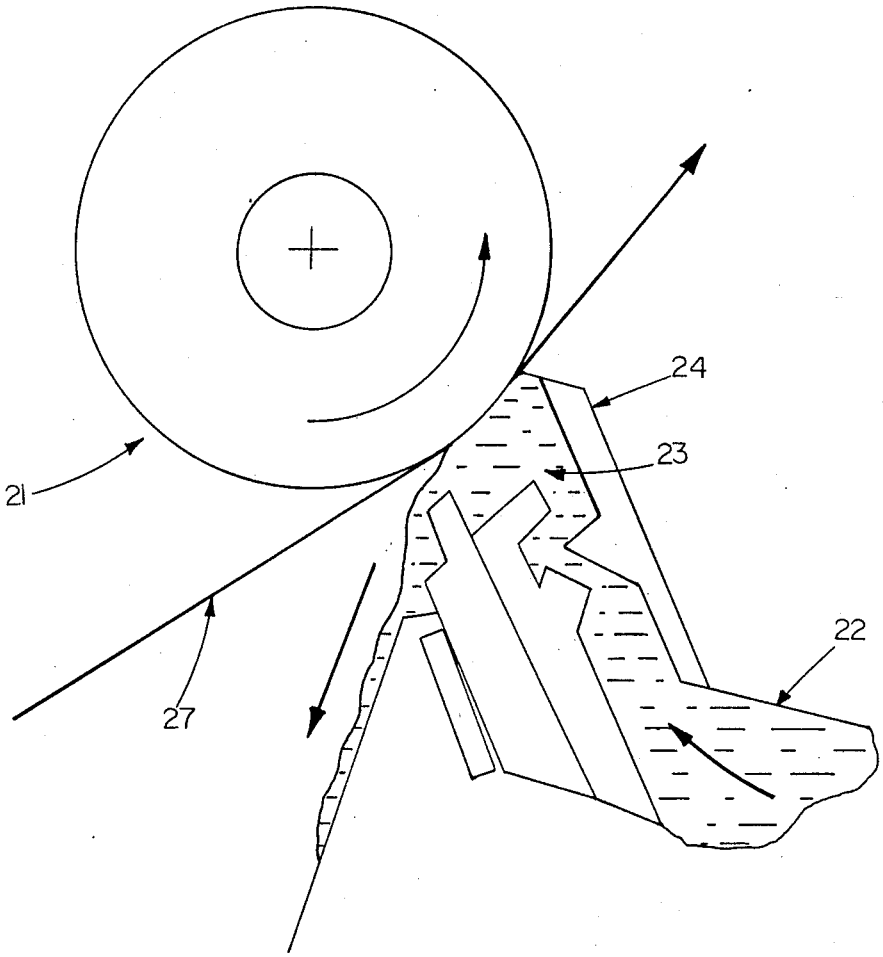
FIG. 2 is a highly diagrammatic representation of apparatus for coating a paper web according to an alternate embodiment of the invention.

FIG. 2 is a diagrammatic representation of a second type of coater 20 known as a "short dwell coater", which is being increasingly implemented by the paper coating industry. This type of coater is operated at very high speed (up to 5000 ft. per min.) with high coating solids loadings. These are very desirable operating conditions. In FIG. 2 the paper web 27 travels at very high speed on the backing roll 21. The coating mixture containing the phospholipid lubricant described in the invention is pumped to the reservoir 22. The coating mixture then passes through the coating head as diagrammed and enters chamber 23. This chamber creates an increased hydraulic pressure of the coating which flows against the paper web. This action applies the coating to the web. The coating is uniformly metered off the sheet with a blade 24.

This lubricant invention has been shown to improve both the wet and dry coating characteristics and runnability when run in this type of coater. Specifically, the problems of whiskering and streaking are either eliminated or greatly reduced.

Lubricant

As described above, the preferred phospholipid for the lubricant is lecithin. Lecithin is a term sometimes used specifically to describe phosphatidyl cholines, but in this application we use the term in its more general sense to include other phosphatidyl derivatives as well, such as phosphatidylinositol, phosphatidylethanolamines, and phosphatidic acid. Particularly, we use the term to include mixtures of phosphatidyl derivatives together with fatty acids. For example commercially supplied lecithin products contain constituent fatty acids such as linoleic, linolenic oleic, palmitic and stearic acids. Most lecithin products supplied in liquid form also contain an oil portion, usually derived from soy beans, and used as a vehicle or solvent for the phospholipid components. Modified lecithins such as hydroxylated lecithins can also be used.

Alcolec BS single-bleached, fluid consistency grade of soya-lecithin available from American Lecithin Company 32–34 61st Street, Woodside, Long Island N.Y. 11377 is a suitable lecithin for use in the invention. Other grades and forms of lecithin may be used. Central Soya Co., Inc. and Ross and Rowe, Inc. (division of Archer Daniels Midland Co.) are also suppliers.

The lecithin is mixed with a vehicle such as oleic acid, palmitic acid, coconut fatty acid, and/or stearic acid. The coating lubricant composition also includes a nonionic emulsifier such as Trydet 2692A available from Emery Industries Inc. P.0. Box 628, Mauldin, S.C. 29662.

Because the lecithin compositions generally are not aqueous dispersible, the emulsifier component is important in order to insure that the lubricant is completely and uniformly dispersed throughout the coating mixture without adverse affect. In addition to fatty acid ethoxylates, a variety of other types of emulsifiers can be employed in this invention including: amine soaps, alkali metal soaps, alkyl phenol ethoxylates, alcohol ethoxylates and amine oxides. The selection of a specific emulsifier system depends on the particular coating mixture formulation for which the invention is intended, and on factors such as type of coating, conditions of use, and end use requirements of the coated paper must be considered.

We have discovered that plasticizer agents can be used in the formulation of the phospholipid lubricant in order to improve the lubricity, rheology, and handling characteristics of the coating to which the invention has been added. Dipropylene glycol has been shown to act as an effective plasticizing agent in this lubricant. Various other glycols may be employed to promote the plasticity characteristics provided by this lubricant invention. Fatty esters, fatty acids, and sulfonated oils may also function successfully as plasticizer agents in this type of coating lubricant.

Because of the generation of very high shear forces and hydraulic pressures encountered at the point of application of the coating mixture, it is important to control the rheological properties of the coating. These coating flow properties include viscosity, shear stability, foaming and homogeneity. As machine speed is increased, the performance demands of the coating lubricant are even more critical.

It has been discovered that the application of this novel phospholipid-containing material as specified in this invention greatly improves the uniformity and quality of the coating in both the wet and dry states. Its use greatly reduces streaking, formation of whiskers, and fish eyes. These terms are familiar to those experienced in the coating art.

The following examples illustrate suitable lubricant compositions.

EXAMPLE 1

A charge of 400 pounds of lecithin is introduced into a vessel and subjected to agitation while being heated to 120° F. A similar weight of oleic acid is added and the mixture is stirred until homogeneous. Trydet 2692A (125#) and Dipropylene Glycol (100#) are added individually, in that order, and the mixture is stirred until homogenous.

The resulting lubricant mixture is then added to a paper coating mixture at a level of 0.2 to 5% based on pigment solids.

EXAMPLE 2

The procedure of Example 1 is followed with the following mixture.

| ITEM | POUNDS |
|---|---|
| 1. Lecithin | 525.0 |
| 2. Red Oil (a mixture of oleic, palmitic, and stearic acid available from Emery Chemicals 15501 N. Lake Drive P.O. Box 429557 Cincinnati, OH 45209) | 350.0 |
| 3. Trydet 2692A (surfactant) | 125.0 |

EXAMPLE 3

The procedure of Example 1 is followed with the following mixture.

| ITEM | POUNDS |
|---|---|
| 1. Lecithin | 462.5 |
| 2. Red Oil | 287.5 |
| 3. Triethanolamine | 62.5 |
| 4. Trydet 2692A | 125.0 |
| 5. Dipropylene Glycol | 62.5 |

EXAMPLE 4

The procedure of Example 1 is followed with the following mixture.

| ITEM | POUNDS |
|---|---|
| 1. Lecithin | 600.0 |
| 2. Red Oil | 250.0 |
| 3. Trydet 2692A | 150.0 |

Other Embodiments

Other embodiments are within the following claims. For example, the phospholipid lubricant may be applied to the paper separately from the coating; e.g., the lubricant may be sprayed onto the moving web to alleviate sticking, picking or dusting.

We claim:

1. A lubricant additive mixture adapted for combination with an aqueous-based paper or paper board coating mixture, said additive mixture comprising a fatty acid, a surfactant, and a phospholipid selected from the group consisting of phosphatidylcholine, phosphatidylethanolamine, phosphatidylinositol, phosphatidic acid and mixtures thereof.

2. The lubricant additive mixture of claim 1 comprising at least one surfactant selected from anonic, nonionic, and cationic surfactants.

3. The lubricant additive mixture of claim 1 comprising a plasticizer.

4. The lubricant additive mixture of claim 3 wherein said plasticizer comprises a glycol.

5. The lubricant additive of claim 1 wherein the emulisifer comprises a fatty acid ethoxylate.

6. The lubricant additive of claim 1 comprising a fatty acid selected from linoleic acid, linolenic acid, oleic acid, palmitic acid, coconut fatty acid, and stearic acids.

7. An aqueous-based paper or paper board coating mixture comprising clay and a phospholipid lubricant selected from the group consisting of phosphatidylcholine, phosphatidylethanolamine, phosphatidylinositol, phosphatidic acid and mixtures thereof.

8. The coating mixture of claim 7 comprising a solid content by weight of between 50 and 75%.

9. The coating mixture of claim 6 or claim 7 having the following composition by weight: 10–90% binder, 10–90% pigment and 0.2–5% of a lubricant additive mixture comprising a phospholipid.

10. The coating mixture of claim 9 wherein said lubricant additive mixture comprises 10–40% fatty acid selected from the group consisting of linoleic, oleic, palmitic, stearic, and coconut fatty acids.

11. The lubricant additive mixture of claim 1 wherein said mixture comprises by weight 10–40% fatty acid.

12. The lubricant additive mixture of claim 11 wherein said mixture comprises 25–75% phospholipid and 5–25% emulsifier.

13. The lubricant additive mixture of claim 1 wherein the emulsifier comprises an alcohol ethoxylate.

* * * * *